United States Patent [19]

Rokohl et al.

[11] 3,945,794

[45] Mar. 23, 1976

[54] PRODUCTION OF LEVEL DYEINGS ON ACRYLONITRILE POLYMER FIBERS WITH BASIC DYES

[75] Inventors: Rudolf Rokohl; Rolf Fikentscher, both of Ludwigshafen, Germany; Herbert Helfert, Trenton, Mich.

[73] Assignee: BASF Aktiengesellschaft, Ludwigshafen (Rhine), Germany

[22] Filed: Feb. 19, 1974

[21] Appl. No.: 443,824

[30] Foreign Application Priority Data

Feb. 24, 1973 Germany ..... 2309327

[52] U.S. Cl. ..... 8/172 R; 8/73; 8/84; 8/177 AB

[51] Int. Cl.[2] ..... D06P 5/06

[58] Field of Search ..... 8/172, 177 AB, 73, 84

[56] References Cited

UNITED STATES PATENTS

| | | | |
|---|---|---|---|
| 3,716,329 | 2/1973 | Komninos et al. | 8/172 X |
| 3,726,641 | 4/1973 | Komninos | 8/172 |

*Primary Examiner*—Lewis T. Jacobs
*Attorney, Agent, or Firm*—Johnston, Keil, Thompson & Shurtleff

[57] ABSTRACT

Acrylonitrile polymer fibers are dyed level shades with basic dyes using as leveling agent a quaternary ammonium salt containing two or three benzyl groups as nitrogen ligands.

5 Claims, No Drawings

PRODUCTION OF LEVEL DYEINGS ON ACRYLONITRILE POLYMER FIBERS WITH BASIC DYES

The invention relates to a process for the production of level dyeings on acrylonitrile polymer fibers with basic dyes using certain quaternary ammonium salts as levelling agents.

Fibers of polyacrylonitrile and acrylonitrile copolymers are mainly dyed with basic dyes. These dyes have high affinity for the fibers and therefore they are absorbed almost completely and give very fast dyeings. The rapid absorption of dye due to the high affinity often results in dyeings which are not level however particularly when dyeing in the critical temperature range from 90° to 96°C. Mitigation is only achieved in some cases by careful control of the temperature. Subsequent levelling of dyeings which are not level, generally referred to as "levelling out" which is fairly easy in the case of natural fibers, does not lead to the desired result with prior art conventional auxiliaries, with oxyethylation products, vinylpyrrolidone and anion-active compounds because of the high affinity of the dye for the fiber.

German Pat. No. 1,148,971 discloses a process in which certain quaternary ammonium compounds are used in which (a) the benzyl group and (b) an aromatic or a hetero-aromatic or cycloaliphatic group are attached direct to the quaternary nitrogen atom as structural elements.

The process according to the said specification represents a great advance in the field of dyeing polyacrylonitrile fibers.

It has been found however that there are drawbacks to the use of these compounds, evident for example in the case of the use of compounds having aromatic radicals in their low stability in storage because of their easy oxidizability, in the case of the use of heteroaromatics by odor nuisance and finally in the case of the use of cycloaliphatic radicals on the nitrogen atom by less than optimum properties.

The said patent specification teaches that with aromatic or hetero-aromatic substituents on the nitrogen atom quaternary compounds are obtained which give fairly satisfactory results as levelling agents but require special attention because of their odor nuisance or lack of stability to oxidation. On the other hand the cycloaliphatic substituents exemplified as possible alternatives result in less favorable, i.e., not optimum, properties.

The present invention has as its object to provide a method of dyeing acrylonitrile polymer fibers which does not have the said drawbacks.

This object is achieved by a process for the production of level dyeings on acrylonitrile polymer fibers with basic dyes using a quaternary ammonium salt as a levelling agent wherein the quaternary ammonium salt used has the formula:

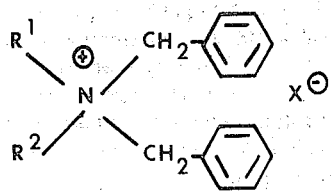

in which $R^1$ and $R^2$ may be identical or different and each is alkyl of one to four carbon atoms or together are alkylene of four to six carbon atoms, $R^1$ may also be benzyl and X is the radical of an organic or preferably inorganic acid.

Compounds in which $R^1$ and $R^2$ together form alkylene containing four to six carbon atoms and particularly hexamethylene are of special interest.

Preferred alkyls for the individual radicals $R^1$ and $R^2$ are methyl, ethyl and propyl, methyl being particularly preferred.

Particularly suitable individual compounds are dibenzyldimethylammonium chloride, tribenzylmethylammonium methosulfate, dibenzyltetramethyleniminium chloride and dibenzylhexamethyleniminium chloride and the corresponding methosulfates.

Other anions, for example hydrogen sulfate, bromide, formate, acetate, tartrate, or toluenesulfonate may be used instead of the said chloride or methosulfate anions. The nature of the anion is without effect on the action of the salt and anions of industrially accessible acids are therefore preferred.

The auxiliaries dissolve well in water. They are not surfaceactive, do not tend to foam and in particular do not affect the fastness properties of the dyeings or the hand of the fabric. Moreover they are odorless and stable to oxidative influences.

The levelling agent may be used in the dye liquor during dyeing; from 0.5 to 5% and preferably from 1 to 4% based on the weight of fiber is required. It is equally possible to level up the fibrous material after dyeing in a blank dye liquor, somewhat larger amounts of from 1.5 to 10% based on the weight of fiber being necessary in the blank dye liquor.

The levelling agents are superior to the agents specified in German Pat. No. 1,148,971 with regard to their levelling effect, twice as good levelling generally being obtained with the agents according to the invention. According to the disclosure of German Pat. No. 1,148,971 an unsatisfactory dyeing as regards levelness is obtained when exact temperature conditions are not maintained. When quaternary ammonium compounds bearing pyridyl or picolyl groups as substituents are used the effect is similar to that of the agents according to the present invention but the serious odor nuisance gives rise to the known drawbacks for personnel in attendance on the machines. The sensitivity to oxidation of compounds having aryl groups which are not of a heterocyclic nature results in less stability in storage of the compounds and in their discoloration and this may involve considerable increases in cost.

The levelling agents to be used according to the invention are particularly well suited to polyacrylonitrile but are also suitable for acrylonitrile copolymers.

Examples of dyes which may be used in combination with the levelling agents to be used according to the invention are dyes of the diarylmethane and triarylmethane series, the indolylarylmethane and diindolylaryl series, oxazine, thiazine, diazine, indoline and cyanine dyes and also basic azo and azomethine dyes.

The non-surface-active auxiliaries to be used according to the invention, in spite of their outstanding levelling effect have very little retarding power so that dye liquors are exhausted very well. Some of them, particularly those in which $R^1$ and $R^2$ together form tetramethylene or hexamethylene exhibit a slight increase in retarding effect, but this in many cases is an additional advantage because a slight retarding power sometimes decreases the speed of absorption. Having regard to the prior art these advantageous properties could not have been foreseen.

Among auxiliaries previously known for dyeing basic synthetic and natural fibers such as wool preferably with wool and polyamide dyes are oxyethylation products of amines and the corresponding quaternary ammonium salts. These auxiliaries are to make it possible to dye more deeply the material to be dyed and to dye union fabrics more uniform hues. These auxiliaries are not suitable however as levelling agents for dyeing with basic dyes on polyacrylonitrile fibers. They have practically no levelling power and a decrease in the rate of absorption of basic dyes is not noticeable unless an uneconomically large amount is used. Moreover these auxiliaries often favor foaming. This disadvantage can be obviated by using according to the invention the quaternized compounds herein specified.

The levelling agents according to the invention may be prepared simply and by classical methods described for example in the following Examples and no more need be said.

The following Examples illustrate the invention. Parts given therein are parts by weight.

EXAMPLE 1

Tribenzylmethylammonium methosulfate 287 parts of tribenzylamine is dissolved in 200 ml of dioxane and reacted with 132 parts of dimethyl sulfate at 70°C. The quaternary salt crystallizes out upon cooling and is suction filtered and dried. The yield is 371 parts and the melting point is 163° to 164°C.

EXAMPLE 2

Dimethyldibenzylammonium chloride 124 parts of 40% dimethylamine is diluted with 129 parts of water. 253 parts of benzyl chloride is dripped into the resulting solution within 1 hour at from 40° to 50°C. 80 parts of 50% caustic soda solution is then dripped in within two hours at from 50° to 70°C and then the whole is kept at from 70° to 80°C for another hour. The whole is allowed to stand for several hours to allow the two liquid phases to separate. The upper phase contains the quaternary salt in a 99% yield.

EXAMPLE 3

20 kg of machine knitting yarn of a copolymer of a predominant amount of acrylonitrile with vinyl acetate is dyed as a hank on a yarn dyeing machine with propeller circulation at a liquor ratio of 40:1 with 1.0% (based on the weight of fiber) of a dye of the formula:

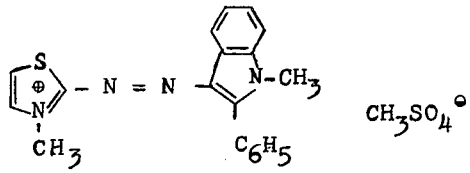

with an addition of 0.3% of glacial acetic acid and 0.5% of anhydrous sodium acetate. The temperature at the start is 65°C. It is raised within 45 minutes to 95°C by raising it by 1°C per minute up to about 80°C and by 2°C per minute from 80°C upward. The whole is then kept at 95°C for another 35 minutes. In spite of the careful control of the temperature the dyeing is not level because the dye is absorbed spontaneously in the range from 85° to 90°C.

Dyeing is carried out under otherwise the same conditions with an addition of 0.4 kg of tribenzylmethylammonium methosulfate (= 2.0%). A satisfactory level dyeing is obtained. The liquor contains only traces of unabsorbed dye.

EXAMPLE 4

An uneven dyeing is prepared from light polyacrylonitrile piece goods by dyeing the textile material with 3% of Basacryl blue 3RL with an addition of 0.5% of glacial acetic acid at 100°C without any precautions being taken.

The blue piece goods dyed unevenly is then treated in a blank liquor which contains glacial acetic acid and sodium acetate in the amounts specified in Example 3 and also 4% of dimethyldibenzylammonium chloride at a liquor ratio of 30:1 for two hours at boiling temperature. The dyeing is level. About 10% of the dye which was on the fiber remains in the liquor.

In the absence of the levelling agent the dyeing remains uneven after boiling for a very long time, for example from five to eight hours, in the blank liquor.

When a retarder, for example laurylbenzyldimethylammonium chloride, is used instead of the said levelling agent, in an amount of 1%, 2% or 4% the dyeing is certainly brightened and it is found that about 20 to 25% of the amount of dye is left in the liquor; the dyeing is however not level. In an attempt to redye the material by adding a further amount of dye, for example by adding 2.5% of a dye of the formula:

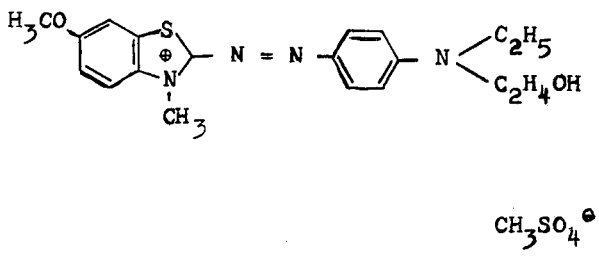

only about 30 to 40% of the added dye has been absorbed after 2 hours. In the case of the piece of Dralon treated with the levelling agent according to the invention it is possible to allow the added dye to be absorbed practically quantitatively.

The same amount of dibenzylhexamethyleniminium chloride instead of dimethyldibenzylammonium chloride gives the same effect.

EXAMPLE 5

400 parts of water, 0.4 part of glacial acetic acid, 2 parts of sodium acetate and 0.2 part of tribenzylethylammonium chloride are placed in a dye beaker having a capacity of 500 parts by volume. 5 parts of the predyed cloth according to Example 4 and 5 parts of white material of the same type are then placed in the beaker and heated for 90 minutes at 100°C. The beaker is closed and rotated in a heating bath about a rotating axis to which it is secured. (Dyeing apparatus on the Launder-Ometer principle.)

The originally uneven dyeing is thus completely equalized, the white material is dyed very deeply. About 10% of the dye remains in the liquor. There is practically no dyeing of the white material when no levelling agent is added. When a retarder is used (cetylbenzyldimethylammonium chloride) only a small amount of dye migrates; the quaternary fatty alkylammonium compound exhibits practically no levelling effect. When a larger amount of retarder is used there is no migration whatever of the dye; the accompanying fibers are completely blocked for a further absorption of dye.

We claim:

1. In a process for the production of level dyeings on acrylonitrile polymer fibers with a basic dye using a quaternary ammonium salt as a levelling agent, the improvement which comprises utilizing as said levelling agent from 0.5 to 10% by weight, with reference to said fibers, of the quaternary ammonium salt of the formula

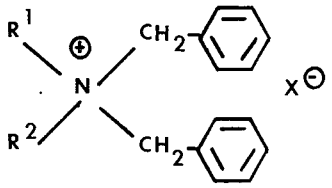

in which $R^1$ is alkyl of one to four carbon atoms or benzyl; $R^2$ is alkyl of one to four carbon atoms; or $R^1$ and $R^2$ taken together form a heterocyclic ring of four to six carbon atoms with $N^+$; and X is the radical of an organic or inorganic acid.

2. A process as claimed in claim 1 wherein levelling is carried out with the quaternary ammonium salt in a blank dye liquor on the dyed material after it has been dyed.

3. A process as claim in claim 1 where $X^-$ in the formula is an anion from the group: $Cl^-$, $Br^-$, $CH_3OSO_3^-$, $HOSO_3^-$, $HCOO^-$, $CH_3—COC^-$, HO-CO—$(CHOH)_2$—$COO^-$ or

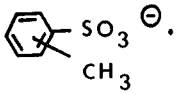

4. A process as claimed in claim 1 wherein the levelling agent is used in the dye liquor in an amount from 0.5 to 5% by weight.

5. A process as claimed in claim 1 wherein the levelling agent is used in the dye liquor in an amount from 1 to 4% by weight.

* * * * *